US008800477B2

(12) United States Patent
Crane et al.

(10) Patent No.: US 8,800,477 B2
(45) **Date of Patent: *Aug. 12, 2014**

(54) MODULE, NOZZLE AND METHOD FOR DISPENSING CONTROLLED PATTERNS OF LIQUID MATERIAL

(75) Inventors: Patrick L. Crane, Dawsonville, GA (US); Michael W. Harris, Cumming, GA (US); Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 474 days.

This patent is subject to a terminal disclaimer.

(21) Appl. No.: 13/104,138

(22) Filed: May 10, 2011

(65) Prior Publication Data

US 2011/0212264 A1 Sep. 1, 2011

Related U.S. Application Data

(60) Division of application No. 12/433,164, filed on Apr. 30, 2009, now Pat. No. 7,950,346, which is a continuation of application No. 11/121,894, filed on May 4, 2005, now Pat. No. 7,647,885, and a continuation of application No. 10/294,867, filed on Nov. 14, 2002, now Pat. No. 6,911,232.

(60) Provisional application No. 60/372,134, filed on Apr. 12, 2002.

(51) Int. Cl.

| | |
|---|---|
| ***B05B 13/00*** | (2006.01) |
| ***B05B 13/02*** | (2006.01) |
| ***B05C 3/12*** | (2006.01) |

(52) U.S. Cl.

USPC ..... 118/325; 118/62; 118/420; 242/157 R; 239/296

(58) Field of Classification Search

CPC ..... B05B 7/0861

USPC ..... 118/307, 325, 300, 420, 62; 239/290, 239/291, 294, 296, 298, 421, 422, 423, 239/601; 427/290, 208.6, 296; 15/309.1; 242/157 R; 156/578, 359

See application file for complete search history.

(56) References Cited

U.S. PATENT DOCUMENTS

| | | | |
|---|---|---|---|
| 2,841,020 | A | 7/1958 | Van Deventer, IV |
| 3,997,308 | A | 12/1976 | Drummond et al. |

(Continued)

FOREIGN PATENT DOCUMENTS

| | | |
|---|---|---|
| EP | 0097414 | 1/1984 |
| EP | 0322538 | 7/1989 |

(Continued)

OTHER PUBLICATIONS

ITW Dynatec(TM), Integra Elastic Strand Coating System, Website, 3 pgs., undated.

(Continued)

*Primary Examiner* — Yewebdar Tadesse

(74) *Attorney, Agent, or Firm* — Wood, Herron & Evans, L.L.P.

(57) ABSTRACT

A liquid dispensing module and nozzle or die tip for discharging at least one liquid filament. The nozzle includes a strand guide for guiding a substrate past the nozzle and a frustoconical protrusion disposed on a surface of the nozzle adjacent the notch. A liquid discharge passage extends along an axis through the frustoconical protrusion and forms an acute angle with a machine direction corresponding to movement of the strand past the nozzle. Four air discharge passages are positioned at the base of the frustoconical protrusion. Each of the air discharge passages is angled in a compound manner generally toward the liquid discharge passage and offset from the axis of the liquid discharge passage to create the controlled pattern of liquid material on the strand.

16 Claims, 8 Drawing Sheets

(56) References Cited

U.S. PATENT DOCUMENTS

| | | | | |
|---|---|---|---|---|
| 4,031,854 | A | 6/1977 | Sprague, Jr. | |
| 4,048,861 | A | 9/1977 | Woidke et al. | |
| 4,135,903 | A | 1/1979 | Ohsato et al. | |
| 4,185,981 | A | 1/1980 | Ohsato et al. | |
| 4,222,758 | A | 9/1980 | Stotler et al. | |
| 4,666,542 | A | 5/1987 | De Jonckheere | |
| 4,801,051 | A | 1/1989 | Lewis et al. | |
| 4,801,345 | A | 1/1989 | Dussaud et al. | |
| 4,842,666 | A | 6/1989 | Werenicz | |
| 4,844,003 | A | 7/1989 | Slautterback et al. | |
| 5,171,512 | A | 12/1992 | Mende et al. | |
| 5,267,693 | A | 12/1993 | Dickey | |
| 5,277,344 | A | 1/1994 | Jenkins | |
| 5,292,068 | A | 3/1994 | Raterman et al. | |
| 5,342,647 | A | 8/1994 | Heindel et al. | |
| 5,406,782 | A | 4/1995 | Inuyama et al. | |
| 5,540,774 | A | 7/1996 | Smitherman | |
| 5,553,758 | A | 9/1996 | Melendy et al. | |
| 5,645,220 | A | 7/1997 | Hohndorf | |
| 5,785,258 | A | 7/1998 | Akin et al. | |
| 5,882,573 | A | 3/1999 | Kwok et al. | |
| 5,902,540 | A | 5/1999 | Kwok | |
| 5,904,298 | A | 5/1999 | Kwok et al. | |
| 5,921,476 | A | 7/1999 | Akin et al. | |
| 6,067,928 | A | 5/2000 | Holzer, Jr. et al. | |
| 6,077,375 | A | 6/2000 | Kwok | |
| 6,250,357 | B1 | 6/2001 | Niedermeyer | |
| 6,253,957 | B1 | 7/2001 | Messerly et al. | |
| 6,311,899 | B1 | 11/2001 | Hidaka et al. | |
| 6,435,425 | B1 | 8/2002 | Saidman | |
| 6,520,237 | B1 | 2/2003 | Bolyard, Jr. et al. | |
| 6,863,225 | B2 | 3/2005 | Nakamura | |
| 6,911,232 | B2 | 6/2005 | Crane et al. | |
| 7,118,558 | B2 | 10/2006 | Wu et al. | |
| 7,175,108 | B2 | 2/2007 | Saine | |
| 7,255,292 | B2 | 8/2007 | Saidman | |
| 7,578,882 | B2 | 8/2009 | Harris et al. | |
| 7,647,885 | B2 * | 1/2010 | Crane et al. | 118/325 |
| 7,950,346 | B2 * | 5/2011 | Crane et al. | 118/325 |
| 2001/0022155 | A1 | 9/2001 | Nakamura | |
| 2002/0134858 | A1 | 9/2002 | Gressett et al. | |
| 2002/0136833 | A1 | 9/2002 | Riney | |
| 2003/0089447 | A1 | 5/2003 | Molee et al. | |
| 2003/0173018 | A1 | 9/2003 | Harris | |
| 2003/0173024 | A1 | 9/2003 | Hayder et al. | |
| 2006/0251806 | A1 | 11/2006 | Brock et al. | |

FOREIGN PATENT DOCUMENTS

| | | |
|---|---|---|
| EP | 0372120 | 6/1990 |
| EP | 0380781 | 8/1990 |
| EP | 0792744 | 9/1997 |
| EP | 1176232 | 1/2002 |
| GB | 2118021 | 10/1983 |
| JP | 61152801 | 7/1986 |
| JP | 11244774 | 9/1999 |
| JP | 02001259497 | 9/2001 |
| JP | 2001347209 | 12/2001 |
| WO | 9604874 | 2/1996 |
| WO | 9954057 | 10/1999 |

OTHER PUBLICATIONS

European Patent Office, Supplementary European Search Report in Corresponding EP Application No. 03721603, Feb. 8, 2007.

European Patent Office, Supplementary European Search Report in Corresponding EP Application No. 04001330, Feb. 19, 2007.

Nordson Corporation, Summit(TM) Lamination Applications, Brochure, Aug. 2006.

Syang-Peng Rwei, Dog Legging in the Melt Spinning Process, Polymer Engineering and Science, vol. 38, No. 2, pp. 341-347, Feb. 1998.

J&M Laboratories, Durastitch(TM) Technology, New Product Release Manual, Feb. 1997.

Nordson Corporation, Nordson Debuts New Look, New Products at INDEX '99, trends published by Nordson Corporation for the Nonwovens Industry, vol. 11, No. 1, Apr. 1999, pp. 1-4.

Rajiv S. Rao et al., Vibration and Stability in the Melt Blowing Process, Ind. Eng. Chem., 32, pp. 3100-3111, 1993.

U.S. Patent and Trademark Office, Office Action in U.S. Appl. No. 11/276,736, Apr. 4, 2008.

U.S. Patent and Trademark Office, Office Action in U.S. Appl. No. 10/760,911, Sep. 28, 2007.

U.S. Patent and Trademark Office, Final Office Action in U.S. Appl. No. 10/760,911, Apr. 2, 2008.

U.S. Patent and Trademark Office, Office Action in U.S. Appl. No. 10/760,911, Sep. 19, 2008.

European Patent Office, European Search Report in EP Application No. 10176683.0, Oct. 22, 2010.

European Patent Office, European Search Report in EP Application No. 10176678.0, Oct. 21, 2010.

European Patent Office, European Search Report in EP Application No. 09167167, Aug. 26, 2009.

* cited by examiner

MODULE, NOZZLE AND METHOD FOR DISPENSING CONTROLLED PATTERNS OF LIQUID MATERIAL

CROSS-REFERENCE TO RELATED APPLICATIONS

This application is a divisional of application Ser. No. 12/433,164, filed Apr. 30, 2009 (pending) which is a continuation of application Ser. No. 11/121,894, filed May 4, 2005 (now U.S. Pat. No. 7,647,885) which is a continuation of application Ser. No. 10/294,867 filed Nov. 14, 2002 (now U.S. Pat. No. 6,911,232), which claims the benefit of U.S. Provisional Application No. 60/372,134 filed on Apr. 12, 2002 (expired), and the disclosures of which are hereby incorporated by reference herein.

FIELD OF THE INVENTION

The present invention generally relates to a liquid material dispensing apparatus and nozzle and, more specifically, to an apparatus and nozzle for dispensing controlled patterns of liquid adhesive strands or filaments.

BACKGROUND OF THE INVENTION

Many reasons exist for dispensing liquid adhesives, such as hot melt adhesives, in the form of a thin filament or strand with a controlled pattern. Conventional patterns used in the past have been patterns involving a swirling effect of the filament by impacting the filament with a plurality of jets of air. This is generally known as controlled fiberization or CFJ in the hot melt adhesive dispensing industry. Controlled fiberization techniques are especially useful for accurately covering a wider region of a substrate with adhesive dispensed as single filaments or as multiple side-by-side filaments from nozzle passages having small diameters, such as on the order of 0.010 inch to 0.060 inch. The width of the adhesive pattern placed on the substrate can be widened to many times the width of the adhesive filament itself. Moreover, controlled fiberization techniques are used to provide better control of the adhesive placement. This is especially useful at the edges of a substrate and on very narrow substrates, for example, such as on strands of material, such as Lycra®, used in the leg bands of diapers. Other adhesive filament dispensing techniques and apparatus have been used for producing an oscillating pattern of adhesive on a substrate or, in other words, a stitching pattern in which the adhesive moves back-and-forth generally in a zig-zag form on the substrate. Some types of these dispensers or applicators have a series of liquid and air orifices arranged on the same plane.

Conventional swirl nozzles or die tips typically have a central adhesive discharge passage surrounded by a plurality of air passages. The adhesive discharge passage is centrally located on a protrusion which is symmetrical in a full circle or radially about the adhesive discharge passage. A common configuration for the protrusion is conical or frustoconical with the adhesive discharge passage exiting at the apex. The air passages are typically disposed at the base of the protrusion. The air passages are arranged in a radially symmetric pattern about the central adhesive discharge passage, as in the protrusion itself. The air passages are directed in a generally tangential manner relative to the adhesive discharge passage and are all angled in a clockwise or counterclockwise direction around the central adhesive discharge passage.

Conventional meltblown adhesive dispensing apparatus typically comprise a die tip having multiple adhesive or liquid discharge passages disposed along an apex of a wedge-shaped member and air passages of any shape disposed along the base of the wedge-shaped member. The wedge-shaped member is not a radially symmetric element. Rather, it is typically elongated in length relative to width. The air is directed from the air discharge passages generally along the side surfaces of the wedge-shaped member toward the apex and the air impacts the adhesive or other liquid material as it discharges from the liquid discharge passages to draw down and attenuate the filaments. The filaments are discharged in a generally random manner.

Various types of nozzles or die tips, such as those of the type described above, have been used to dispense adhesive filaments onto one or more elastic strands. For such applications, the strand or strands typically need to be guided at specific spaced apart positions as the adhesive is discharged onto the strand or strands. For this purpose, strand guides may take the form of rollers which are fixed to the dispensing module or some other fixed structure. While this works appropriately in many situations, the strand guides do present additional expense and spacing considerations.

SUMMARY OF THE INVENTION

The invention provides an adhesive applicator that results in repeatable filament orientation with improved placement control. Further, the invention provides a predictable relationship between a specific geometric configuration of liquid and air discharge passages and the resulting pattern width and frequency. Thus, the nozzle configuration can be controlled to give a tighter, high frequency filament pattern or a more open, lower frequency filament pattern.

The present invention generally provides a liquid dispensing module or applicator for discharging at least one liquid filament onto a moving substrate in a particular pattern such as a generally swirling pattern. The dispensing module includes a dispenser or module body for receiving pressurized liquid and air and a nozzle is coupled to the module body. In one exemplary embodiment, the nozzle comprises a nozzle body having a first side and an opposite second side with the first side coupled to the module body and including a liquid supply port and an air supply port coupled with respective liquid and air supply passages of the module body. A frustoconical protrusion extends from a recessed or inwardly angled surface formed into the second side of the nozzle body. A liquid discharge passage extends along an axis through the apex of the frustoconical protrusion. The liquid discharge passage communicates with the liquid supply port of the nozzle body. The nozzle body further includes a plurality of air discharge passages positioned proximate the frustoconical protrusion. In an exemplary embodiment, at least two of the air discharge passages are positioned on a surface which is recessed into the second side of the nozzle body, adjacent the frustoconical protrusion. Each of the side surfaces and each of the air discharge passages is angled in a direction generally toward the liquid discharge passage.

Preferably, the nozzle body includes four of the air discharge passages positioned in a generally square pattern about the liquid discharge passage. In one exemplary embodiment, two of the air discharge passages are positioned adjacent the frustoconical protrusion and two of the air discharge passages are positioned at lower positions of the nozzle body. The nozzle body further includes a strand guide coupled directly to the nozzle body for guiding movement of a strand of substrate material. In one exemplary embodiment, the strand guide comprises a notch formed into a lower surface of the nozzle body and having opposed sidewalls for guiding a strand past the nozzle. The liquid and air discharge passages have outlets positioned near the notch so that the liquid may be deposited on the strand in a desired pattern. In another exemplary embodiment, the notch extends between side surfaces of the nozzle body, and the side surfaces form acute angles with a mounting surface of the nozzle body.

The method of this invention generally involves dispensing a filament of adhesive onto a strand from a liquid discharge passage forming an acute angle with the direction of movement of the strand. The filament of adhesive is impinged by process air from a plurality of process air discharge passages. Advantageously, the impingement points of the process air streams with the adhesive are preferably also closely proximate the strand. While the liquid filament discharge passage is generally oriented in the direction that the strand moves, it is also oriented or angled toward the strand in the preferred method.

The inventive concepts apply to dispensing modules having one or more sets of the liquid and air discharge passages. For many applications, it will be desirable to provide a nozzle having multiple side-by-side sets of liquid and air discharge passages with each set configured as described above. In each case, a desirable liquid pattern is achieved by the angular orientation of the air discharge passages with respect to the liquid discharge passage. As a result, different configurations of the air and liquid discharge passages may be made with predictable results.

These and other features, objects and advantages of the invention will become more readily apparent to those of ordinary skill in the art upon review of the following detailed description, taken in conjunction with the accompanying drawings.

DETAILED DESCRIPTION OF PREFERRED EMBODIMENTS

Figure 1:
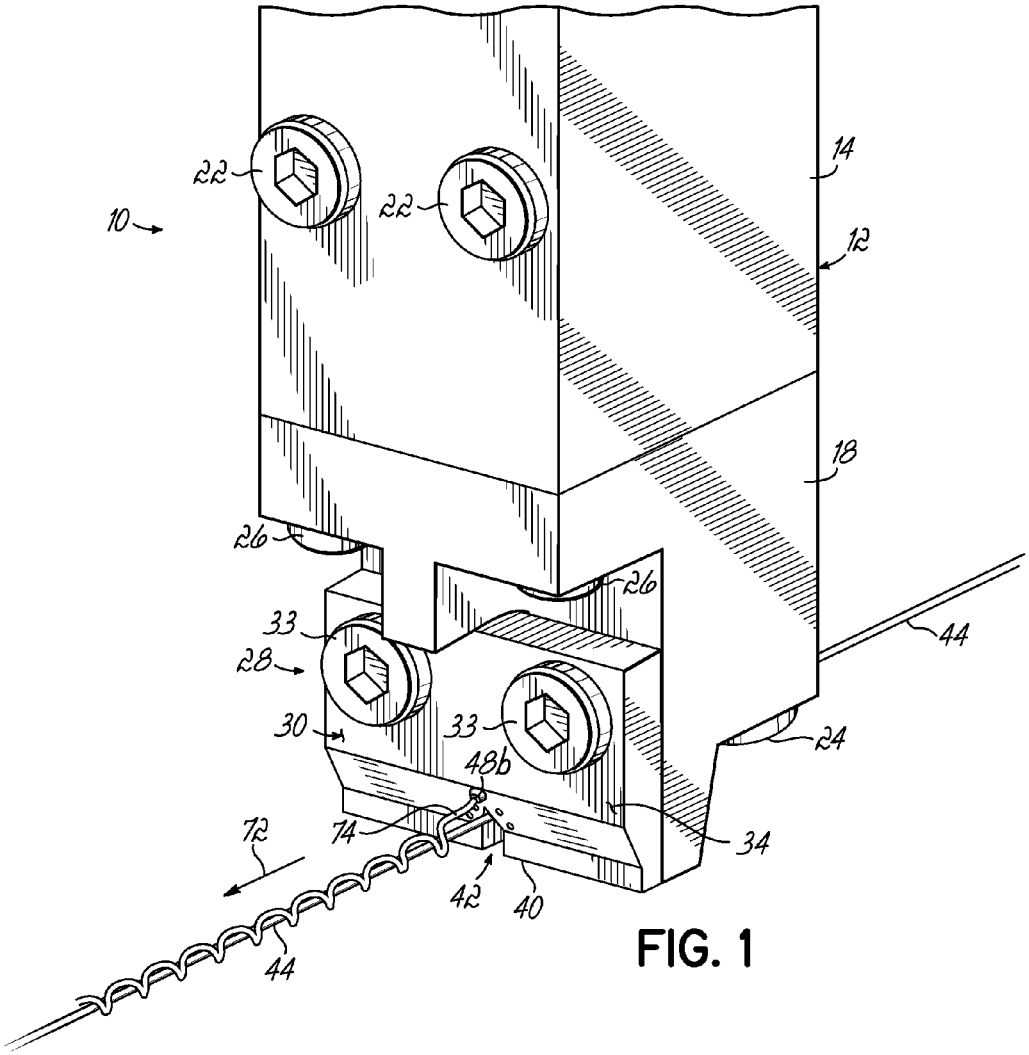
FIG. 1 is a perspective view of a dispensing module including one nozzle or die tip constructed in accordance with a preferred embodiment of the invention.
Figure 2:
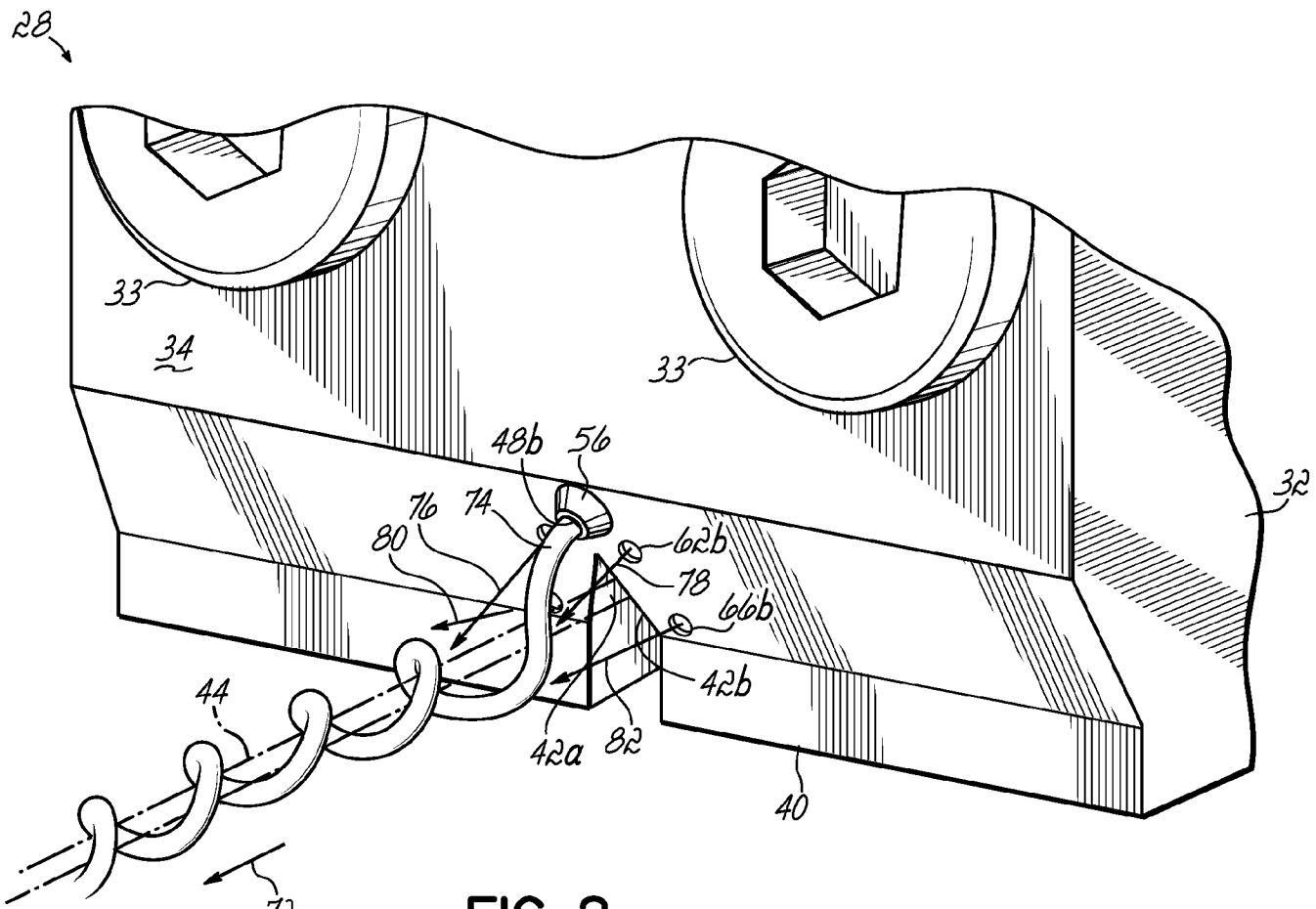
FIG. 2 is an enlarged perspective view of the nozzle or die tip of FIG. 1.

Referring first to FIGS. 1 and 2, an exemplary dispensing module 10 of the present invention is shown. Dispensing module 10 generally comprises a module body 12 including a central body portion 14 and a lower body portion 18. An upper cap (not shown) is secured to central body portion 14 by fasteners (not shown). Central body portion 14 includes fasteners 22 for securing module 10 to a suitable support, such as a manifold (not shown) which supplies liquid, such as hot melt adhesive, to module 10. Lower body portion 18 is secured to central body portion 14 by respective pairs of fasteners 24, 26. A nozzle assembly or die tip assembly 28 receives liquid and pressurized air from respective supply passages. Nozzle assembly 28 is secured to lower body portion 18 and includes a nozzle or die tip 30. Fasteners 33 secure nozzle 30 to lower body portion 18. Module or applicator 10 is preferably of the on/off type and includes internal valve structure for selectively dispensing liquid, such as hot melt adhesive or other viscous liquid typically formed from polymeric material, in the form of one or more filaments. A suitable module structure usable in connection with nozzle 30 is part no. 309637 available from Nordson Corporation, Westlake, Ohio, which is the assignee of the present invention.

Referring first to FIGS. 2-8, a nozzle 30 is shown constructed in accordance with the preferred embodiment. Nozzle 30 includes a body 32 preferably formed from a metal such as brass and having a front surface 34, a rear surface 36, an upper surface 38 and a lower surface 40. A V-shaped notch 42 is formed in lower surface 40 and is generally defined by a pair of converging opposed sidewalls 42*a*, 42*b*. Notch 42 serves as a guide to direct an infed strand 44 of substrate material past air and liquid outlets of nozzle body 32. Rear surface 36 is adapted to be secured against the face of a dispenser and receives liquid material, such as hot melt adhesive, through a liquid inlet port 46 extending into body 32. Liquid inlet port 46 further communicates with a liquid discharge passage 48 having a longitudinal axis 48*a* extending in a plane which includes a centerline 43 of notch 42. In the exemplary embodiment shown, axis 48*a* forms an angle of 37° to lower surface 40. The liquid discharge passage 48 thus forms an acute angle with rear surface 36. In another exemplary embodiment, the angle between the liquid discharge passage and the rear surface 36 is approximately 60° to 80°. An outlet 48*b* of liquid discharge passage 48 is located in a semi-circular recess 54 formed into front surface 34 proximate the apex of notch 42. The liquid discharge outlet 48*b* is at the apex of a frustoconical protrusion 56 that extends from semi-circular recess 54 in a direction along axis 48*a*. Air inlet recesses 50, 52 are formed into rear surface 36 and communicate with four air discharge passages 60, 62, 64, 66 extending along respective axes 60*a*, 62*a*, 64*a*, 66*a*.

Figure 3:
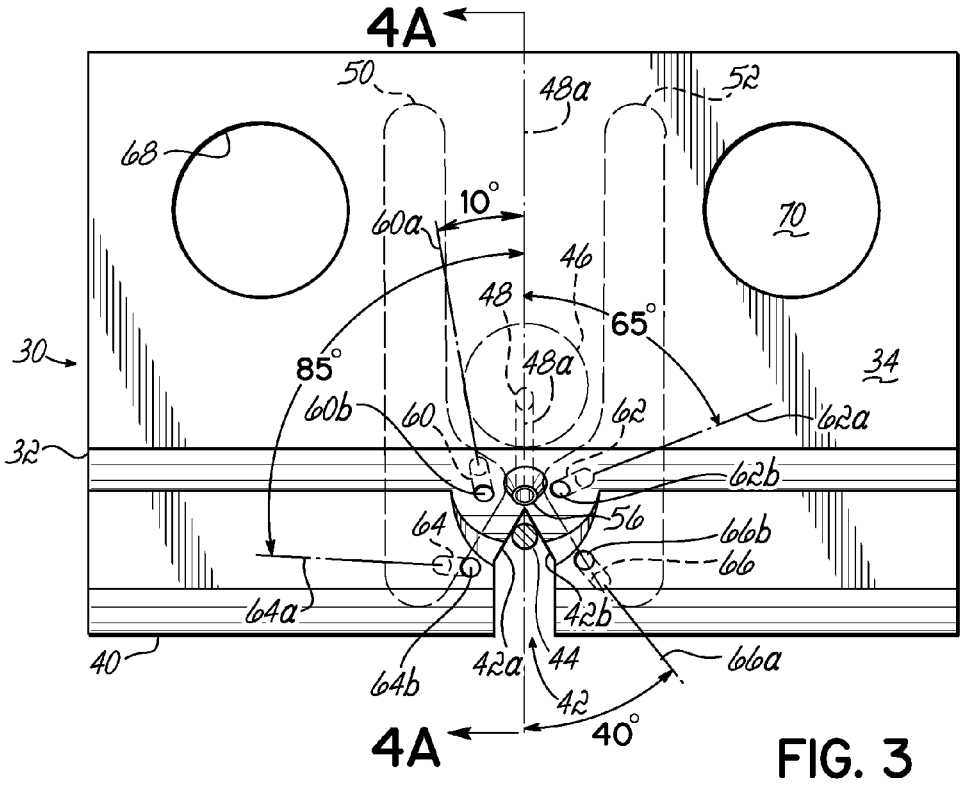
FIG. 3 is a front elevational view showing the discharge portion of the nozzle or die tip.
Figure 4A:
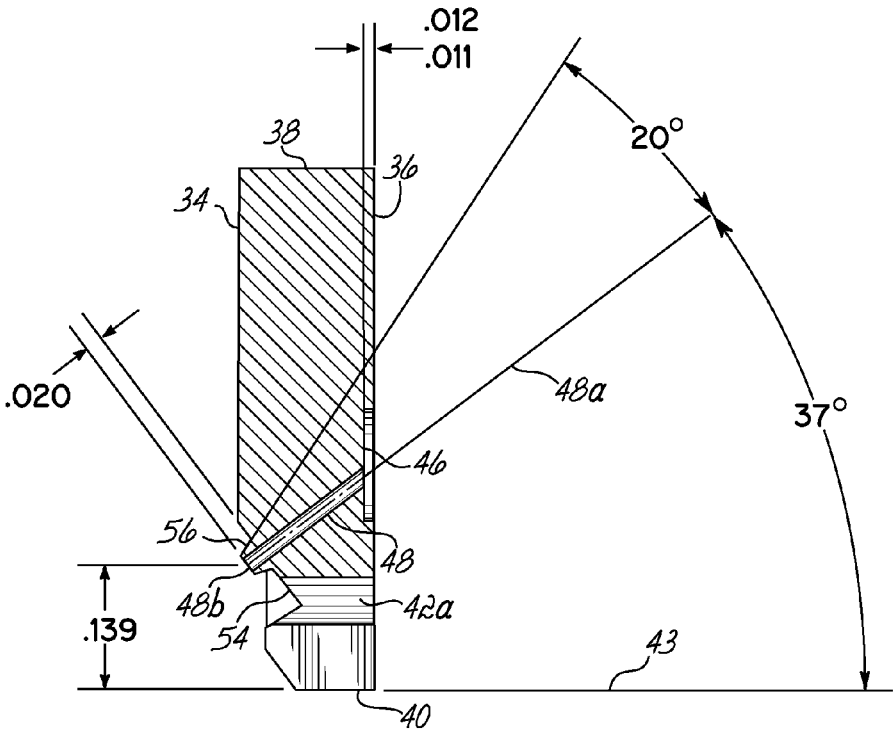
FIG. 4A is a cross-sectional view of the nozzle or die tip taken along line 4A-4A of FIG. 3.
Figure 4:
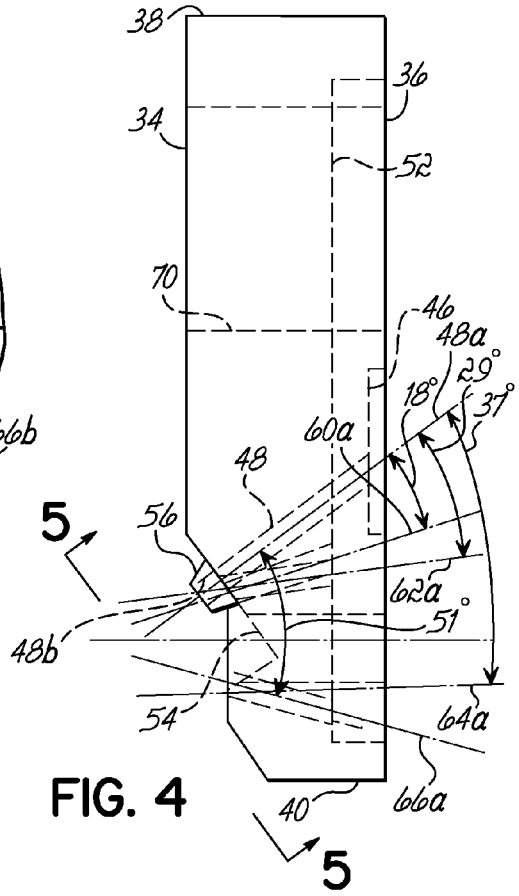
FIG. 4 is a side elevational view of the nozzle or die tip.
Figure 6:
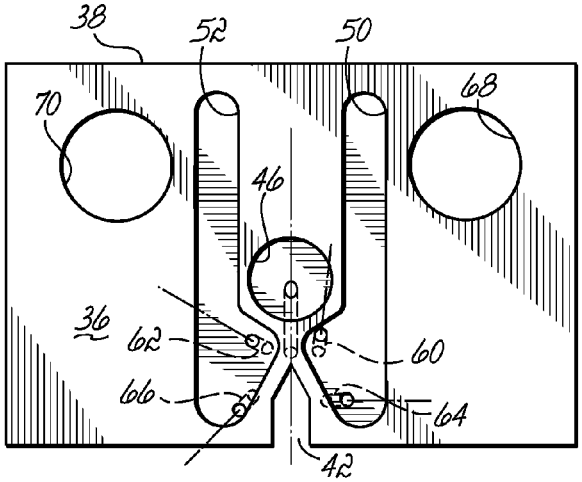
FIG. 6 is a rear elevational view of the nozzle or die tip.
Figure 7:
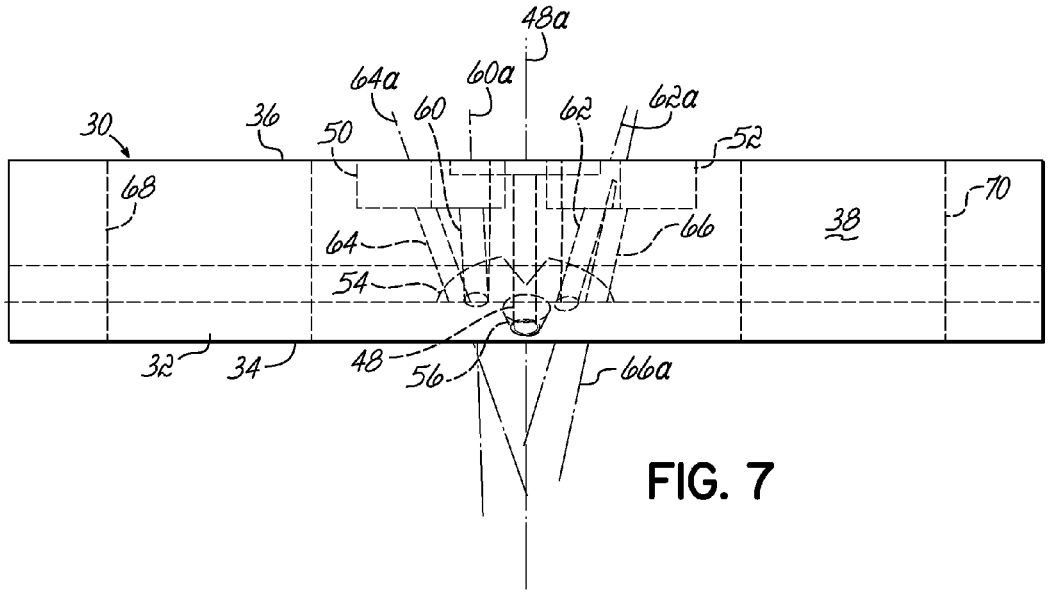
FIG. 7 is a top view of the nozzle or die tip.

Air discharge passages 60, 62, 64, 66 exit at outlets 60*b*, 62*b*, 64*b*, 66*b* on front surface 34 and on semi-circular recess 54, adjacent liquid discharge outlet 48*b* best shown in FIGS. 3 and 4. Air discharge passages 60, 62, 64, 66 discharge pressurized air generally toward axis 48*a* of liquid discharge passage 48, with compound angles best comprehended by reviewing both FIGS. 3 and 5. Holes 68, 70 extend through body 32 for receiving fasteners 33 (FIG. 1) used to secure nozzle 30 to a dispenser.

As viewed from the front surface 34 of nozzle body 32 (FIG. 3), axes 60*a*, 64*a* of air discharge passages 60, 64 are disposed at approximately 10° and 85°, respectively, from the axis 48*a* of liquid discharge passage 48. Axes 62*a*, 66*a* of passages 62, 66 are disposed at approximately 65° and 40° from axis 48*a*, as measured from lower surface 40. As viewed from the side of nozzle body 32, the axes 60*a*, 62*a*, 64*a*, 66*a* of air discharge passages 60, 62, 64, 66 form angles of approximately 18°, 29°, 37°, and 51° with axis 48*a* of liquid discharge passage 48 as best depicted in FIG. 4.

The four discharge outlets 60*b*, 62*b*, 64*b*, 66*b* have centers which are positioned along a common radius from a point corresponding to the location of a substrate received into notch 42. In an exemplary embodiment, the centers of air discharge outlets 60*b*, 62*b*, 64*b*, and 66*b* are positioned along a radius located from a point which is 0.027-inch from the apex of notch 42 when notch 42 has converging side walls 42*a* and 42*b* separated by an angle of 60°. This corresponds to a strand 44 having a cross sectional diameter of 0.031 inch.

Figure 5:
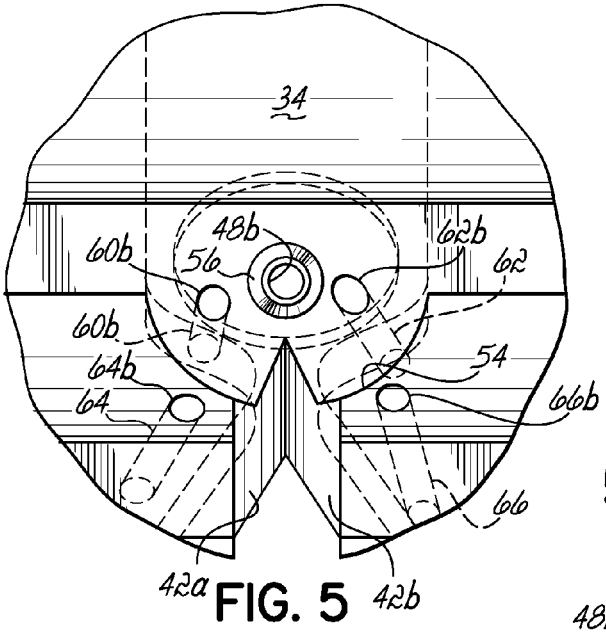
FIG. 5 is an enlarged view of the nozzle discharge portion shown in FIG. 3.

The four discharge outlets 60*b*, 62*b*, 64*b*, 66*b* are arranged to form a generally square pattern below the liquid discharge outlet 48*b* when viewed along axis 48*a*, as depicted in FIG. 5. Pressurized air from air discharge outlets 60*b*, 62*b*, 64*b*, 66*b* is directed in directions generally tangential to the liquid filament discharging from passage 48, as opposed to directly impacting the filament discharging from passage 48. The size of the swirl pattern produced by pressurized air from air discharge outlets 60*b*, 62*b*, 64*b*, 66*b* impinging upon liquid filament as it exits liquid discharge outlet 48*b* may be adjusted by varying the angular orientation of air discharge passages 60, 62, 64, 66.

FIGS. 1 and 2 illustrate operation of an exemplary nozzle of the present invention and a swirl pattern which is produced by the exemplary nozzle. A substrate in the form of a strand 44 is received into notch 42 and moves in a direction indicated by the arrow 72. As the strand 44 passes beneath liquid discharge outlet 48*b*, a liquid filament 74 is dispensed from the outlet 48*b* generally also in the direction of arrow 72, but with a downward angle as well, and deposited on the strand 44. Jets of pressurized air from air discharge outlets 60*b*, 62*b*, 64*b*, and 66*b* are directed generally tangentially toward the liquid filament 74, as depicted by arrows 76, 78, 80, 82 in FIG. 2. The jets of pressurized air cause the liquid filament 74 to move in a swirling motion as it is deposited on the strand 44. After the filament 74 has been deposited on the strand 44, portions of the liquid filament 74 may be drawn by gravity to wrap around the substrate 44.

Figure 8:
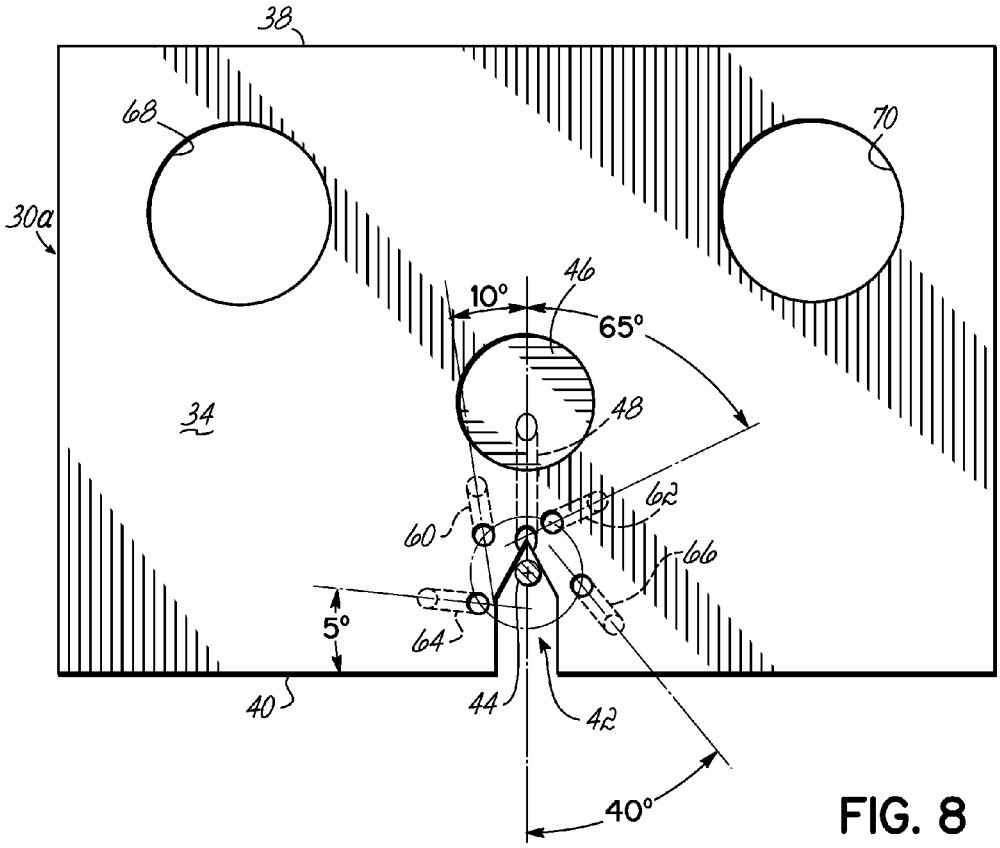
FIG. 8 is a front elevation view of an alternative nozzle or die tip in accordance with the invention.

FIG. 8 illustrates one of many possible alternative configurations for a nozzle or die tip 30'. In this regard, the front face of nozzle 30' is a flat surface and is not beveled or inset to angle the various passages downwardly as in the first embodiment. All other reference numbers are identical as between FIGS. 1-7 and FIG. 8 and the description thereof may be referred to above for an understanding of this embodiment as well.

Figure 9:
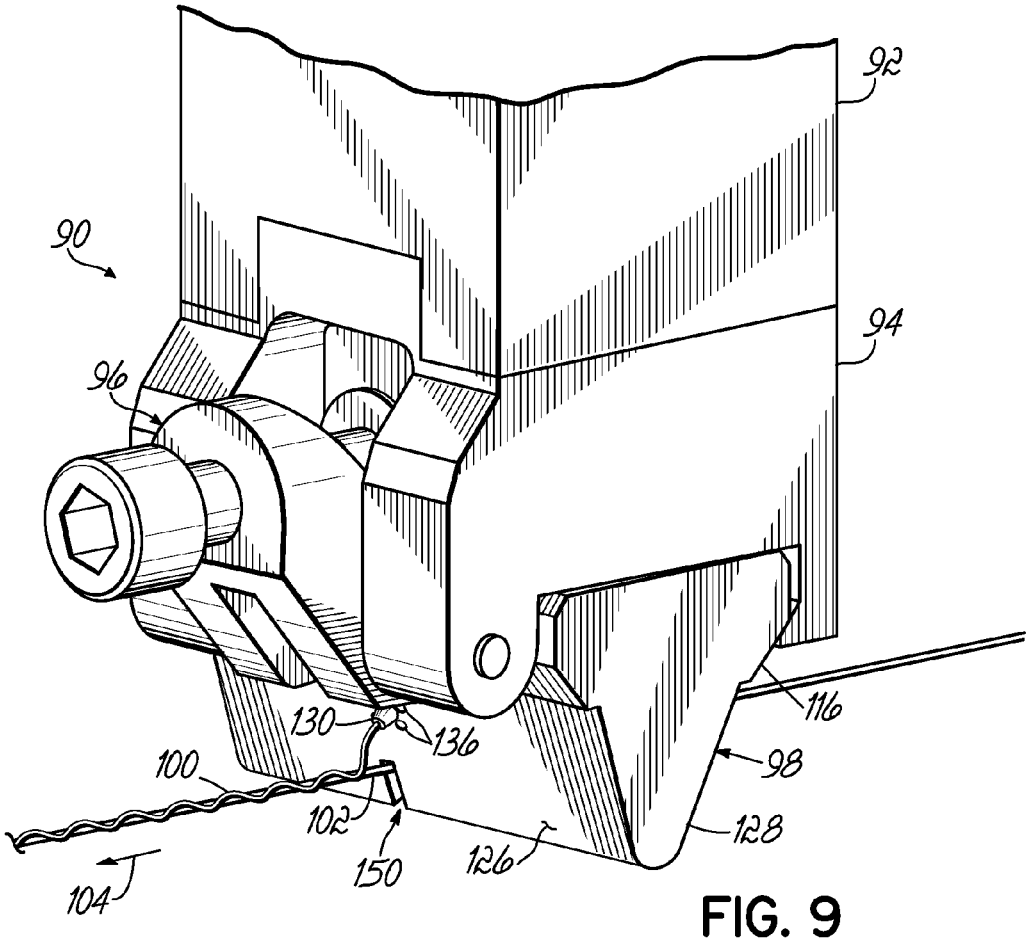
FIG. 9 is a perspective view of another exemplary dispensing module and nozzle of the present invention.

Referring to FIGS. 9-14, there is shown another exemplary dispensing module 90 and nozzle 98 according to the present invention. The dispensing module 90 depicted in FIG. 9 is similar to the exemplary dispensing module 10 of FIG. 1, having a central body portion 92 and a lower body portion 94, but further including a quick disconnect mechanism 96 for facilitating the installation and removal of various nozzles or dies from the dispensing module 90, as more fully described in U.S. patent application Ser. No. 09/814,614, filed on Mar. 22, 2001 and assigned to the assignee of the present invention. FIG. 9 further illustrates another exemplary nozzle 98 coupled to the dispensing module 90 and secured with the quick disconnect mechanism 96. Nozzle 98 receives liquid and pressurized air from the dispensing module 90 and dispenses a filament of liquid material 100 in a controlled pattern to a strand of substrate material 102 moving relative to the die 98, generally in the direction of arrow 104, in a manner similar to that described above with respect to nozzle 30.

Figure 10:
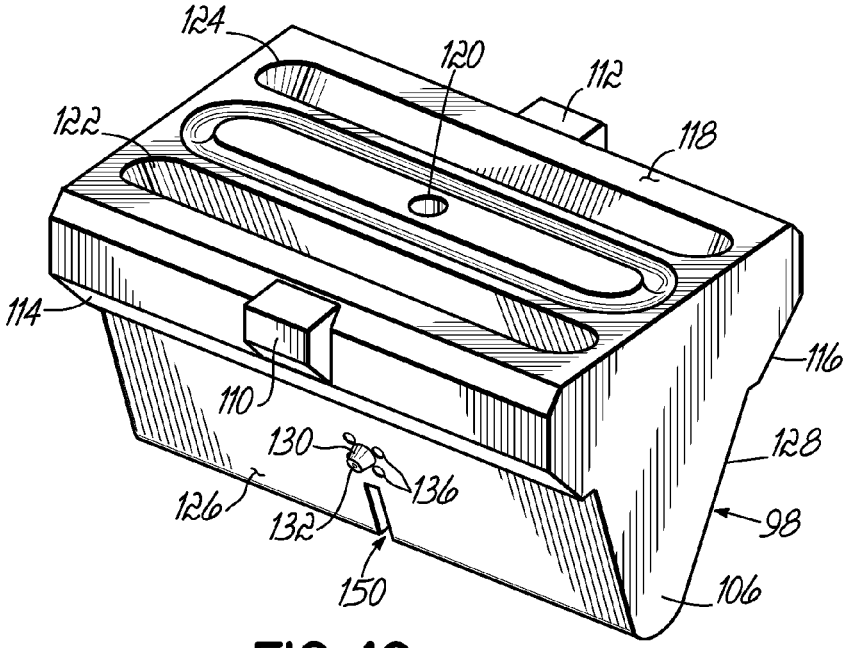
FIG. 10 is a perspective view of the nozzle of FIG. 9.
Figure 11:
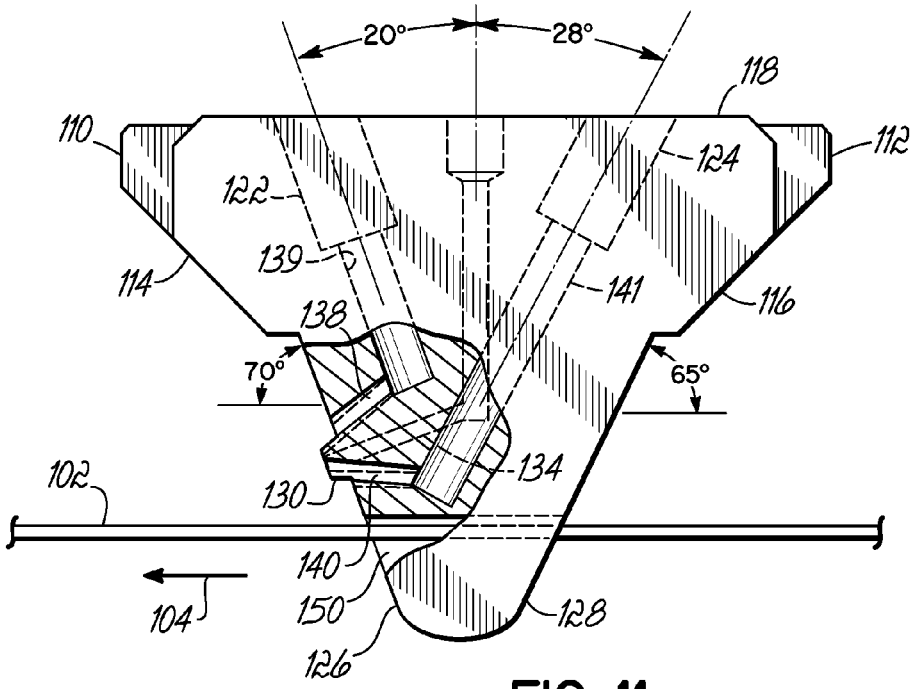
FIG. 11 is a side view of the nozzle of FIG. 10, depicting air and liquid passages of the nozzle.
Figure 12:
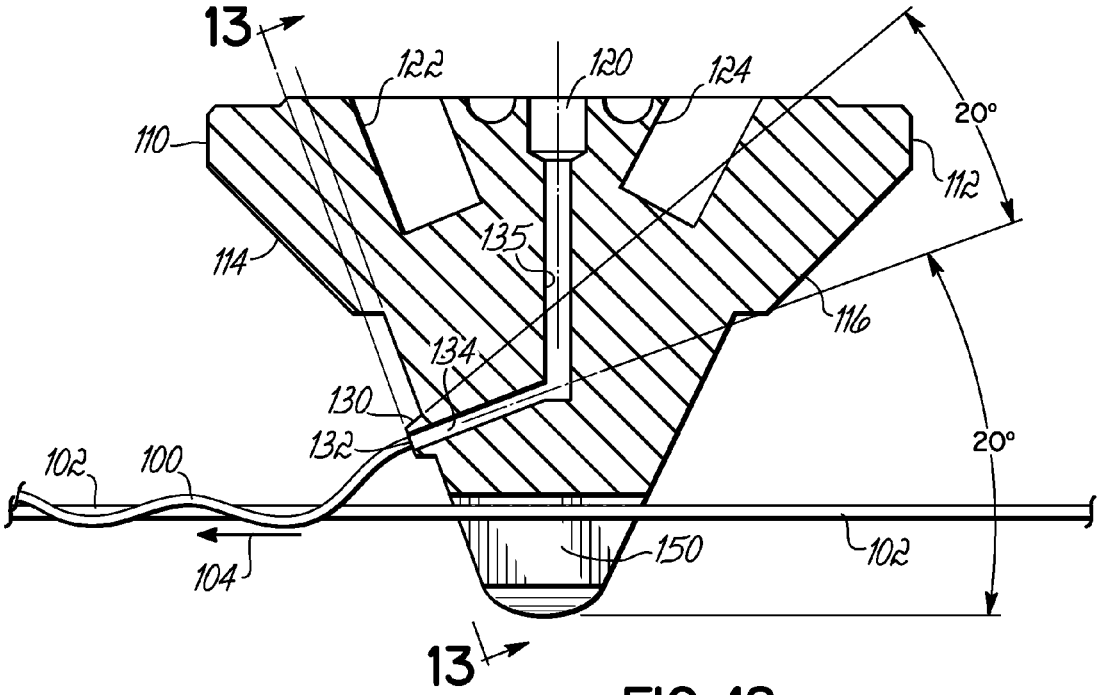
FIG. 12 is a cross-sectional view of the nozzle of FIG. 10, through the center of the nozzle.

Referring now to FIG. 10, the exemplary nozzle 98 is shown in more detail. Nozzle 98 comprises a nozzle body 106 and includes protrusions 110, 112 and angled cam surfaces 114, 116, as more fully described in U.S. patent application Ser. No. 09/814,614, to facilitate coupling the nozzle 98 with the dispensing module 90. The nozzle body 106 includes a first side 118 configured to mount to the lower portion 94 of the dispensing module 90. The first side 118 includes a liquid supply port 120 and first and second process air supply ports 122, 124 which mate to corresponding liquid and air supply passages in the dispensing module 90 in a manner similar to that described above for module 10. As depicted in FIGS. 10-12, the exemplary nozzle body 106 has a generally wedge-shaped cross-section including second and third sides 126, 128. A frustoconically-shaped protrusion 130 extends from the second side 126 of the nozzle body 106 and includes a liquid discharge outlet 132 disposed on a distal end of the protrusion 130. The liquid discharge outlet 132 is in fluid communication with a liquid discharge passage 134, which in turn is in communication with the liquid supply port 120 by way of a liquid passage 135, whereby liquid material from the module 90 may be dispensed from the liquid discharge outlet 132 to the strand 102 of substrate material as more clearly depicted in FIGS. 11 and 12. At least a portion of the liquid discharge passage 134 is oriented to form an acute angle with a plane parallel to the first side 118, and thus forms an angle with a direction corresponding to movement of the strand 102, generally indicated by arrow 104. The liquid discharge passage of the exemplary embodiment is inclined at approximately 20° to the first side, whereby the liquid material is dispensed from the liquid discharge outlet to the strand and generally in the direction of strand movement.

Figure 13:
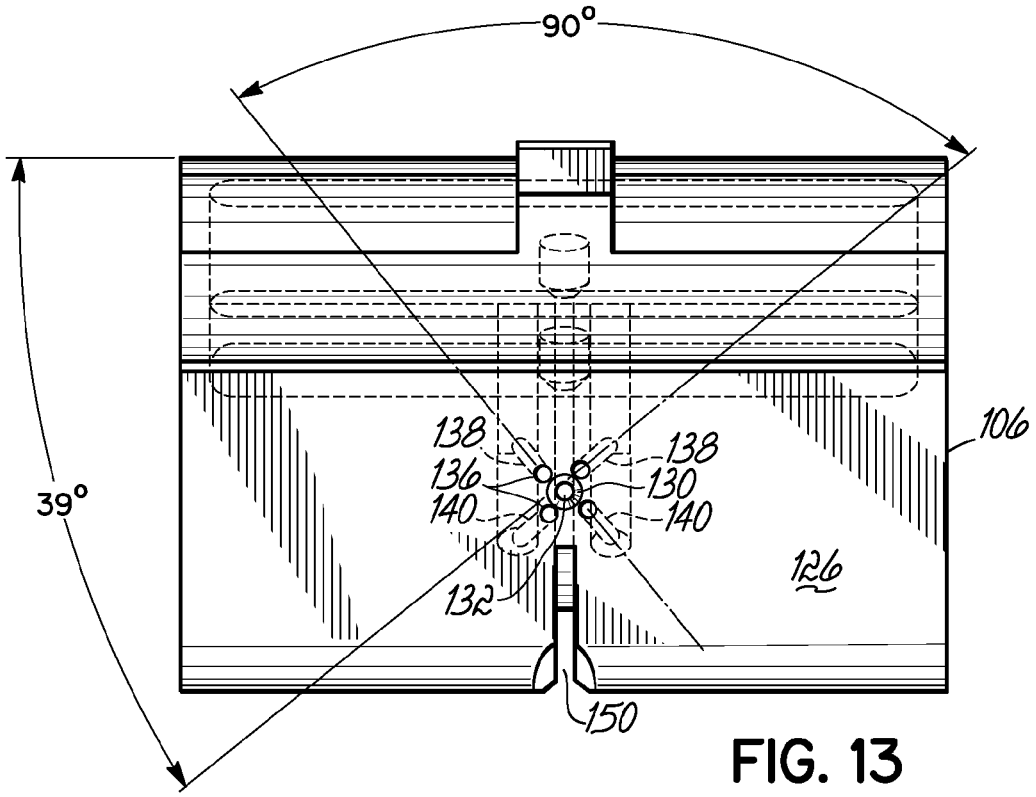
FIG. 13 is a view of the nozzle of FIG. 10, taken along line 13-13 in FIG. 12.
Figure 14:
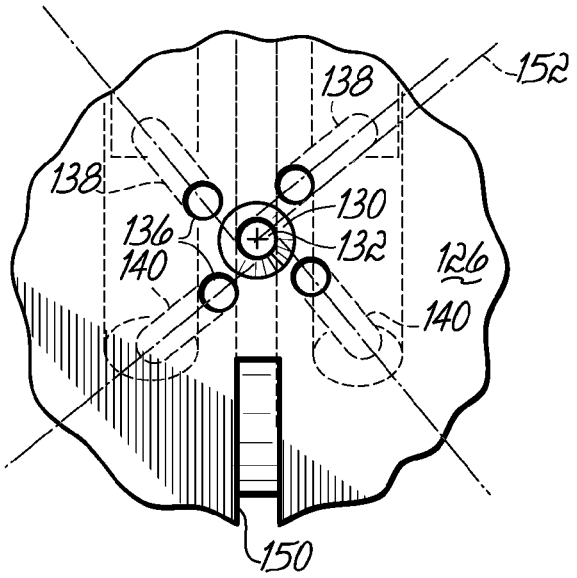
FIG. 14 is a detail view of the air and discharge outlets of FIG. 13.

The second side 126 of the nozzle body 106 further includes a plurality of air discharge outlets 136 proximate the liquid discharge outlet 132 and in fluid communication with air discharge passages 138, 140 by way of respective air passages 139, 141 which extend to the air supply ports 122, 124 on the first side 118 of the nozzle body 106. The air discharge passages 138, 140 of the exemplary nozzle body 106 are inclined at approximately 20° and approximately 28° from an axis through liquid passage 135. As shown in FIGS. 13 and 14, the air discharge outlets 136 are arranged generally around the base of the frustoconical protrusion 130 and are configured to direct process air toward the liquid filament 100 dispensed from the liquid discharge outlet 132 in a manner similar to that described above for nozzle 30.

In the exemplary nozzle body 106, four air discharge outlets 136 are disposed in a generally square pattern around the liquid discharge outlet 132 at the base of the frustoconical protrusion 130. Diagonally opposite air discharge passages 138, 140 or, in other words, air discharge passages disposed at opposite corners of the square-shaped pattern, are symmetric and disposed in planes that are at least nearly parallel to each other. The air discharge passages 138, 140 are each offset from axes 152 that are normal to a longitudinal axis of the liquid discharge passage 134, and each forms a true angle of approximately 30° with the longitudinal axis of the liquid discharge passage 134 such that the air stream discharged from each air discharge passage 138 is tangential to the liquid filament 100 discharged from the liquid discharge passage 134, as opposed to directly impacting the filament 100. This arrangement of air and liquid discharge passages provides a liquid filament which is moved in a controlled manner as it is dispensed from the liquid discharge passage to create a desired pattern on the strand 102 of substrate material. Variation of the pattern is possible by adjusting the offset spacing and orientation of the air discharge passages 138, 140 relative to the liquid discharge passage 134, as will be apparent to those skilled in the art.

The nozzle body 106 further includes a notch 150 formed into an end of the nozzle body 106 opposite the first side 118 and proximate the liquid discharge outlet 132 to direct the strand 102 of substrate material past the air and liquid discharge outlets 132, 136 disposed on the second side 126 of the nozzle body 106. As shown more clearly in FIGS. 11 and 12, the notch 150 extends between the second and third sides 126, 128 of the nozzle body 106. In an exemplary embodiment, the second and third sides 126, 128 are configured to form acute angles with the first side 118. In one exemplary embodiment, the second side 126 forms an angle of approximately 60-80° with the first side 118. In another aspect of the invention, the third side 128 forms an angle no greater than approximately 70° with the first side 118. Advantageously, the angle of the third side 128 facilitates the passage of knots formed in the strand 102 without causing breakage of the strand 102. These knots are typically formed in the infed strand material, for example, when the trailing end of a first length of strand material is secured to the leading end of a second length of strand material from a supply to permit continuous operation of the module 90.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein what is claimed is:

The invention claimed is:

1. A dispensing module for dispensing a controlled pattern of liquid material onto a strand moving along a line in a machine direction, comprising:

a module body including a flat interface;

a nozzle body including a first side including a flat surface mounted to said flat interface of said module body, and a second side;

a liquid supply port and a process air supply port in said nozzle body;

a liquid discharge passage connected in fluid communication with said liquid supply port and including a liquid discharge outlet on said second side of said nozzle body, said liquid discharge passage extending along an axis that extends through said liquid discharge outlet and is oriented at an acute angle to a plane parallel to said flat surface so as to form an acute angle with the machine direction when the nozzle is discharging liquid onto the strand in the machine direction; and a plurality of process air discharge passages connected in fluid communication with said process air supply port, a plurality of process air discharge outlets associated with said liquid discharge outlet on said second side of said nozzle body and said plurality of process air discharge passages connected in fluid communication with said plurality of process air discharge outlets.

2. The module of claim 1, further comprising a strand guide including a notch positioned proximate to said liquid discharge outlet and including an opening for receiving the strand and guiding the movement of the strand, said opening facing in a direction away from said liquid discharge outlet when receiving the strand and guiding the movement of the strand.

3. The module of claim 2, wherein said strand guide is directly coupled with said nozzle body.

4. The module of claim 3, wherein said directly coupled strand guide is integrally formed with said nozzle body.

5. The module of claim 1, wherein said liquid discharge outlet is on a frustoconical protrusion extending from said second side of said nozzle body.

6. The module of claim 1, wherein said nozzle body has a lower edge positioned proximate to the strand and said plurality of process air discharge passages further comprises two process air discharge passages including two air discharge outlets positioned between said liquid discharge outlet and said lower edge, and further including two additional process air discharge passages and corresponding air discharge outlets located above said liquid discharge outlet.

7. The module of claim 1, wherein said nozzle body has a lower edge positioned proximate to the strand and at least one of said plurality of process air discharge passages and the corresponding air discharge outlet is positioned between said liquid discharge outlet and said lower edge.

8. The module of claim 1, wherein said axis forms an angle of approximately 53° with the plane parallel to said flat surface.

9. The module of claim 1, wherein said axis forms an angle of at least approximately 20° with the plane parallel to said flat surface.

10. The module of claim 1, further comprising:

a plurality of liquid discharge outlets in said nozzle body, said liquid discharge outlets connected in fluid communication with said liquid supply port and adapted to discharge the liquid material onto a plurality of strands;

a plurality of air discharge outlets associated with each liquid discharge outlet, said air discharge outlets connected in fluid communication with said process air supply port; and a strand guide including a plurality of notches respectively positioned proximate said plurality of liquid discharge outlets, said notches including respective openings for receiving the strands and guiding the movement of the strands, said openings facing in directions away from said liquid discharge outlets when receiving the strands and guiding the movement of the strands.

11. A dispensing module for dispensing a filament of liquid material in a controlled pattern onto a strand moving along a line in a machine direction, comprising:

a module body including an interface;

a nozzle body including a first side mounted to said interface of said module body, and a second side;

a liquid supply port and a process air supply port in said nozzle body;

a liquid discharge passage connected in fluid communication with said liquid supply port and including a liquid discharge outlet on said second side of said nozzle body, said liquid discharge passage extending along an axis that extends through said liquid discharge outlet and is oriented at an acute angle of approximately 20 degrees with the machine direction when the nozzle is discharging liquid onto the strand moving along a line in the machine direction; and a plurality of process air discharge passages connected in fluid communication with said process air supply port, and a plurality of process air discharge outlets connected in fluid communication with said plurality of process air discharge passages and associated with said liquid discharge outlet on said second side of said nozzle body.

12. The module of claim 11, wherein said nozzle body further comprises:

a plurality of liquid discharge passages connected in fluid communication with said liquid supply port and a plurality of respective liquid discharge outlets communicating with said liquid discharge passages and adapted to discharge the liquid material onto a plurality of strands, each of said liquid discharge passages extending along an axis that extends through a respective one of said discharge outlets and is oriented at an acute angle of approximately 20 degrees with the machine direction when the nozzle is discharging liquid onto the strands moving along a line in the machine direction.

13. A dispensing nozzle for dispensing a filament of liquid material in a controlled pattern onto a strand moving along a line in a machine direction, comprising:

a nozzle body including a first side adapted to be mounted to an interface of a module body, and a second side;

a liquid supply port and a process air supply port in said nozzle body;

a liquid discharge passage connected in fluid communication with said liquid supply port and including a liquid discharge outlet on said second side of said nozzle body, said liquid discharge passage extending along an axis that extends through said liquid discharge outlet and is oriented at an acute angle of approximately 20 degrees with the machine direction when the nozzle is discharging liquid onto the strand moving along a line in the machine direction; and a plurality of process air discharge passages connected in fluid communication with said process air supply port, and a plurality of process air discharge outlets connected in fluid communication with said plurality of process air discharge passages and associated with said liquid discharge outlet on said second side of said nozzle body.

14. A dispensing module for dispensing a controlled pattern of liquid material onto a strand, comprising:

a module body including an interface;

a nozzle body mounted to said interface and having a liquid supply port for receiving the liquid material from said module body and a process air supply port for receiving process air from said module body, a liquid discharge passage connected in fluid communication with said liquid supply port, and a plurality of process air discharge passages connected in fluid communication with said process air supply port; and a strand guide coupled directly with said nozzle body and having opposed sidewalls positioned adjacent said liquid discharge passage, said strand guide configured to receive and guide movement of the strand.

15. A dispensing module for dispensing a controlled pattern of liquid material onto a strand moving along a line in a machine direction, the dispensing module comprising:

a module body including an interface;

a nozzle body including a first side mounted to said interface, a second side, a liquid supply port, a process air supply port, a liquid discharge passage in fluid communication with said liquid supply port and including a liquid discharge outlet on said second side of said nozzle body, said liquid discharge passage extending along an axis that extends through said liquid discharge outlet and forms an acute angle with the machine direction when the nozzle is discharging liquid onto the strand, a plurality of process air discharge passages in fluid communication with said process air supply port, and a plurality of air discharge outlets, each communicating with one of said air discharge passages and associated with said liquid discharge outlet; and a strand guide including a notch with an opening for receiving the strand and guiding the movement of the strand, said opening facing in a direction away from said liquid discharge outlet when receiving the strand and guiding the movement of the strand, said notch positioned proximate to said liquid discharge outlet.

16. A dispensing module for dispensing a controlled pattern of liquid material onto a strand moving along a line in a machine direction, the dispensing module comprising:

a module body including an interface;

a nozzle body including a first side mounted to said interface, a second side, and a lower edge adapted to be positioned proximate the strand, a liquid supply port and at least one process air supply port each located on said first side, and a liquid discharge passage in fluid communication with said liquid supply port and opening on said second side, said liquid discharge passage including a liquid discharge outlet and extending along an axis extending through said liquid discharge outlet and forming an acute angle with the strand when the nozzle is discharging liquid onto the strand in the machine direction; and a plurality of air discharge passages in fluid communication with said process air supply port and opening on said second side, and an air outlet communicating with one of said air discharge passages and positioned between said liquid discharge outlet and said lower edge.

* * * * *